United States Patent [19]

Batey et al.

[11] Patent Number: 5,036,195

[45] Date of Patent: Jul. 30, 1991

[54] GAS ANALYZER

[75] Inventors: Johnathan H. Batey, Kingsley; Donald S. Richards, Middlewich, both of United Kingdom

[73] Assignee: VG Instruments Group Limited, Crawley, England

[21] Appl. No.: 438,533

[22] Filed: Nov. 17, 1989

[30] Foreign Application Priority Data

Nov. 18, 1988 [GB] United Kingdom ..... 8826966

[51] Int. Cl.[5] ..... H01J 49/26

[52] U.S. Cl. ..... 250/288; 250/281

[58] Field of Search ..... 250/281, 282, 288, 423 R

[56] References Cited

U.S. PATENT DOCUMENTS

| | | | |
|---|---|---|---|
| 4,137,453 | 1/1979 | Siegel | 250/382 |
| 4,157,423 | 6/1979 | Kambara | 250/423 R |
| 4,172,021 | 10/1979 | Gladish | 204/192.1 |
| 4,501,965 | 2/1985 | Douglas | 250/288 |
| 4,682,026 | 7/1987 | Douglas | 250/288 |
| 4,776,923 | 10/1988 | Spencer et al. | 204/192.32 |
| 4,794,252 | 12/1988 | Bateman et al. | 250/288 |
| 4,812,040 | 3/1989 | Marcus et al. | 250/288 |
| 4,853,539 | 8/1989 | Hall et al. | 250/288 |
| 4,891,515 | 1/1990 | Jones et al. | 250/288 |

FOREIGN PATENT DOCUMENTS

| | | |
|---|---|---|
| 231131 | 8/1987 | European Pat. Off. . |
| 237259 | 9/1987 | European Pat. Off. . |
| 1117789 | 6/1968 | United Kingdom . |
| 1149632 | 4/1969 | United Kingdom . |
| 1255962 | 12/1971 | United Kingdom . |
| 1371104 | 10/1974 | United Kingdom . |
| 2129607 | 5/1984 | United Kingdom . |

OTHER PUBLICATIONS

"The PF ($A^3\Pi - X^3\Sigma^-$) Spectrum From He ($Z^3S$)+$PF_3$: Extended Vibrational Anal. and PF(A) Vibrational Populations", Roychowdhurg et al., *Chem. Phy.* 118 pp. 427–435, 1987.

"Sample Introduction System for Atmospheric Pressure Ionization Mass Spectrometry of Non Volatile Compounds", Kambara, *Anal. Chem.*, 54, pp. 143–146, 1982.

"Medium Resolution Atmospheric Pressure Ionization Mass Spectrometer", O'Brien et al., *Rev. Sci. Inst.* 59, (4), pp. 573–578, 1988.

"A Negative Ion Source for Detection of Trace (PPT) Electrophilics in Air", Gould et al., 24A nn, Confer. on Mass Spectrum, May 1976, p. 426.

*Primary Examiner*—Bruce C. Anderson

*Attorney, Agent, or Firm*—Chilton, Alix & Van Kirk

[57] ABSTRACT

A mass spectrometer for the analysis of substances in a gas comprises means for generating a plasma in an enclosure through which a gas flows, conduit means for conveying the gas from the enclosure to a sampling member, and a mass analyzer for mass analyzing ions characteristic of the substances which pass through an aperture in the sampling member. The conduit means is constructed so that a line-of-sight path does not exist between the interior of the enclosure and the aperture in the sampling member. Substances for analysis may be introduced into the gas before or after it passes through the plasma enclosure. When the plasma comprises a pulsed DC glow discharge the spectrometer is useful for the analysis of traces of electrophillic substances in the gas.

29 Claims, 3 Drawing Sheets

GAS ANALYZER

Figure 1:
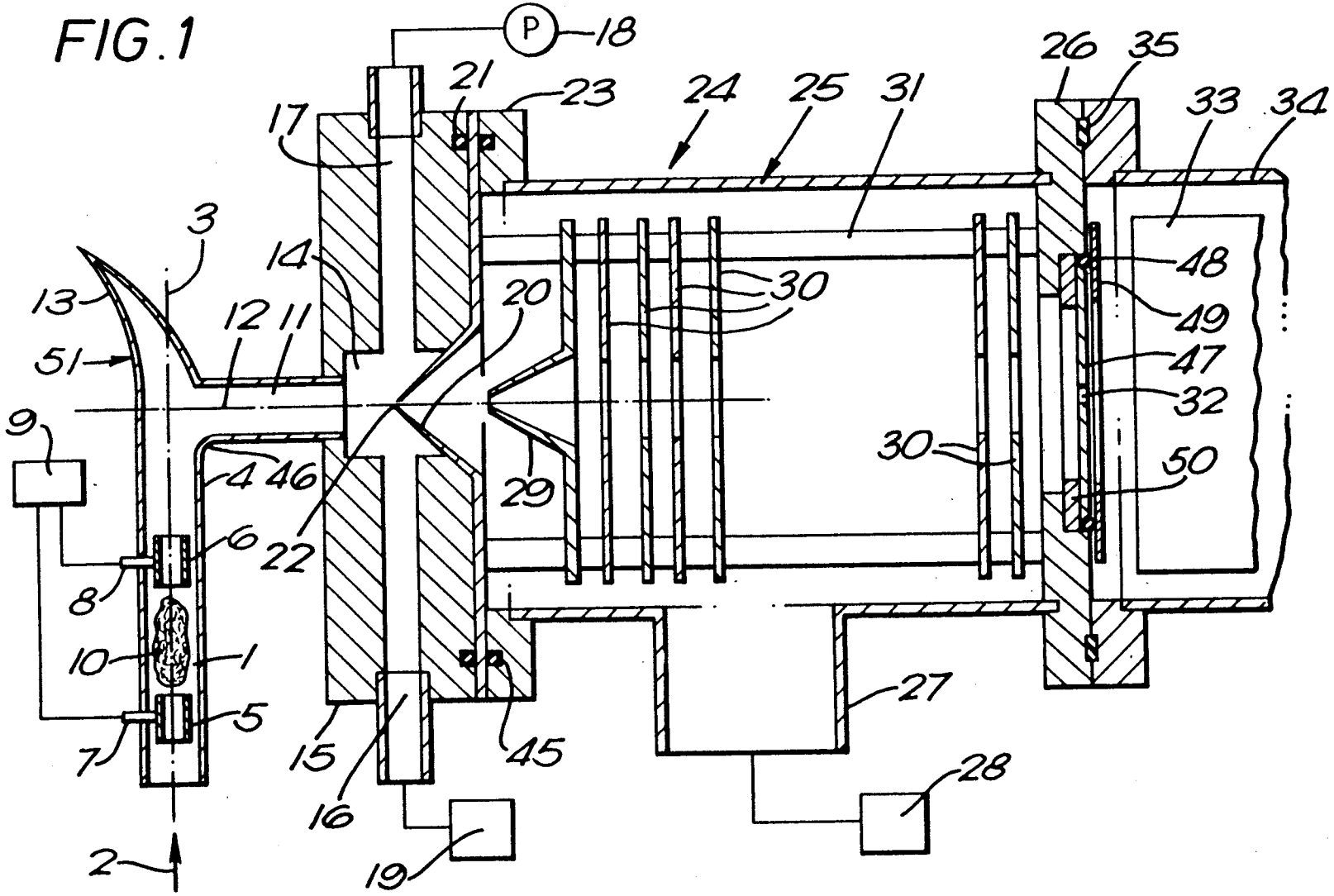

This invention relates to apparatus for the analysis of a sample of matter present in a flowing gas in the form of either a vapor, small solid particles, or droplets of liquid. In particular, it relates to apparatus comprising means for creating a discharge in the gas and a mass analyzer for analyzing ions characteristic of the sample which are formed as a result of the discharge.

Ion sources for mass spectrometers in which a sample is ionized by means of a gaseous plasma are known. For example, glow discharges are used to sputter material from a solid sample and subsequently ionize the sputtered material to produce ions characteristic of the elements present in the solid, and inductively coupled plasmas and microwave plasmas are used to ionize aerosol samples to produce ions characteristic of the elements in a solution. In these ion sources, sample molecules are decomposed into ions characteristic of the elements they contain, but it is also known to use discharge sources for the production of molecular ions. Certain atmospheric pressure ionization (API) sources employ a corona discharge at atmospheric pressure to produce molecular ions of organic compounds (eg, Grange, O'Brien and Barofsky, Rev. Sci. Instrum. 1988, vol. 59(4) pp 573–, and Kambara, Analytical Chemistry, 1982, vol. 54 pp 143–). Glow discharges are also used for the analysis of organic samples in solution (eg, Bateman, Jones, European Patent Application No. 252758).

Mass spectrometers based on all of the above techniques are often capable of detecting very small quantities of a sample, especially when it is such that stable negative ions are formed by the discharge, for example in the analysis of chlorinated and fluorinated molecules such as freons and molecules containing nitro ($NO_2$) groups. Some of them are therefore especially useful as a highly specific and sensitive technique for analyzing air pollutants and for detecting traces of explosives. In particular, Gould and Miller (24th Ann. Confr. on Mass Spectrom. and Allied Topics, San Diego, 1976, pp 426–) have developed a pulsed glow discharge ion source capable of detecting 1 part in $10^{12}$ of $SF_6$ in air. This source simply comprises two electrodes disposed either side of a tube through which the gas is caused to flow at a pressure of between 2 and 10 torr. A D.C. supply, controlled by a pulse generator and of sufficient voltage to strike a glow discharge in the flowing gas is connected across the electrodes, and ions are extracted from the discharge through an aperture in a sampling cone disposed on the axis of the tube downstream of the electrodes. The repetition rate and duty cycle of the discharge ae selected for optimum sensitivity, and a repetition rate of about 300 Hz is generally satisfactory.

Unfortunately, the high sensitivity of this source observed for $SF_6$ is not achieved with all the species which it would be desirable to analyze. In common with most discharge sources, a major limitation on the sensitivity arises from the magnitude of the background signal, even when the source is used with a mass analyzer fitted with an off-axis detector, as is now conventional. Another problem encountered with such a source is instability of the discharge itself which leads to a fluctuation in the level of the background signal.

It is an object of the invention to provide an improved mass spectrometer in which a sample present in a flowing gas may be ionized by a discharge, flame or corona, and which produces a lower background signal in the absence of the sample than previously known types. It is a further object to provide an improved mass spectrometer having a pulsed glow discharge ion source and which has greater sensitivity than previously known types.

In accordance with these objectives there is provided a mass spectrometer for the analysis of a sample of matter comprised in a flow of gas, said spectrometer comprising:

a) means for causing gas comprising a said sample of matter to flow through a plasma enclosure;

b) means for forming a plasma in gas within said plasma enclosure;

c) conduit means through which gas and products formed in said plasma may flow from said plasma enclosure to a sampling member;

d) a sampling aperture formed in said sampling member through which aperture ions characteristic of said sample of matter may pass from said conduit means into a mass analyzer;

e) means for venting from said conduit means gas which does not pass through said sampling aperture; and f) means for maintaining said mass analyzer at a pressure of less than $10^{-3}$ torr;

said conduit means being so constructed that there exists no line-of-sight path between the interior of said plasma enclosure and said the sampling aperture in said sampling member.

In an alternative embodiment, the invention provides a mass spectrometer for the analysis of a sample of matter, said spectrometer comprising:

a) means for causing gas to flow through a plasma enclosure;

b) means for forming a plasma in said gas within said plasma enclosure;

c) conduit means through which gas may flow from said plasma enclosure to a sampling member;

d) means for introducting a said sample of matter into said gas in said conduit means whereby to form ions characteristic of said sample by reaction of said sample with excited species present in said gas which have been generated in said plasma;

e) a sampling aperture formed in said sampling member through which ions characteristic of said sample may pass from said conduit means into a mass analyzer;

f) means for venting from said conduit means gas which does not pass through said sampling aperture; and g) means for maintaining said mass analyzer at a pressure of less than $10^{-3}$ torr;

said conduit means being so constructed that there is no line-of-sight path through between the interior of said plasma enclosure and said sampling aperture in said sampling member.

In the present specification, the term "plasma" encompasses a glow discharge, microwave discharge, corona discharge or any other similar type of ionizing media.

The conduit means may conveniently comprise a first conduit member through which flows gas from the plasma enclosure and a second conduit member through which the gas leaving the first conduit member may flow to the sampling aperture. The axes of the first and second conduit members may then be arranged to intersect at an angle and a position such that no line-of-sight path exists between the plasma enclosure and the sampling aperture.

Alternatively the conduit means may comprise an entrance portion through which the gas flows on leaving the plasma enclosure and an exit portion through which the gas flows towards the sampling aperture. In the entrance portion the gas flow may be generally aligned with a first axis and in the exit portion it may be generally aligned with a second axis. In accordance with the invention the first and second axes may be inclined to each other or displaced from one another so that no line-of-sight path exists between the sampling aperture and the interior of the plasma enclosure. Alternatively or additionally, light path interrupting means may be provided between the entrance and exit portions, for example a Wood's horn or a series of baffles.

Conveniently, the mass analyzer may be a quadrupole mass analyzer.

In another embodiment, at least one electrostatic lens comprising one or more elements is provided between the sampling aperture and the mass analyzer for transmitting ions from the aperture into the analyzer.

In further preferred embodiments the means for forming a plasma comprises electrodes disposed in the plasma enclosure and connected to a direct current power supply. The means for venting may comprise pumping means for maintaining the pressure of gas in the plasma enclosure within the range 0.1-20 torr, so that a DC glow discharge is produced in the plasma enclosure. Advantage is also had by arranging the direct current power supply to provide a pulsed output whereby the glow discharge is repetitively established in the plasma enclosure for short periods which are separated by periods when no such discharge is present.

The electrodes in the plasma enclosure may be spaced apart in the direction of the flow of gas through the enclosure, and preferably each electrode comprises a hollow cylinder disposed with its axis aligned with the direction of flow.

According to the invention, ions characteristic of the sample which are formed in the plasma, or by the subsequent reaction of the plasma primary products with sample molecules, are carried through the conduit means by virtue of the flow of gas. Therefore in a still further preferred embodiment the means for causing gas flow and the cross-sectional area of the conduit means are selected to ensure that the flow of gas is substantially laminar at least until the vicinity of the sampling member. This minimizes the loss of ions through collisions with the surface of the conduit or by other reactions.

Viewed from another aspect, the invention comprises a method of analyzing a sample of matter contained in a flow of gas, said method comprising:

a) causing gas containing said sample to flow through a plasma enclosure and a plasma to be formed therein;

b) conducting gas leaving said plasma enclosure through a conduit means to a sampling member having a sampling aperture therein thereby permitting ions characteristic of said sample present in the gas to pass from said conduit member through said aperture and into a mass analyzer maintained at a pressure of less that $10^{-3}$ torr and venting from said conduit means gas which does not pass through said sampling aperture; and c) mass analyzing ions characteristic of said sample of matter entering said mass analyzer;

said conduit means being so constructed that there exists no line-of-sight path between said plasma and said sampling aperture.

In an alternative method, the invention comprises a method of analyzing a sample of matter, said method comprising:

a) flowing a gas through a plasma enclosure and forming a plasma therein;

b) conducting gas leaving said plasma enclosure through a conduit means to a sampling member having a sampling aperture therein;

c) introducing a said sample of matter into said gas in said conduit means whereby to produce ions characteristic of said sample by reaction of said sample with excited species generated by said plasma;

d) permitting ions characteristic of said sample present in said gas in said conduit means to pass through said sampling aperture and into a mass analyzer maintained at a pressure of less that $10^{-3}$ torr and venting from said conduit means gas which does not pass through said sampling aperture; and e) mass analyzing ions characteristic of said sample of matter entering said mass analyzer;

said conduit means being so constructed that there exists no line-of-sight path between said plasma and said sampling aperture.

In the above, the term "plasma" encompasses a glow discharge, microwave discharge, corona discharge or any other similar types of ionizing media.

In still further preferred embodiments the glow discharge is pulsed in such a way that electrons formed when the discharge is present react with neutral molecules of the sample to be analyzed, forming stable negative ions characteristic of the sample, typically at a point downstream of the plasma itself and in periods when the glow discharge is extinguished. Typically the glow discharge is pulsed at a rate between 100 Hz and 10 KHz, and the length of the "on" pulse is approximately 5 $\mu$S. Preferably the discharge is struck between electrodes which are spaced apart along the direction of flow of gas in the plasma enclosure. A preferred range of pulse repetition frequencies is between 200 and 500 Hz. Further preferably, a flow rate of between 500 cc and 41 /min (at atmospheric pressure) of gas through the plasma enclosure is suitable, and further preferably the gas in which the sample is entrained comprises nitrogen.

Surprisingly, the inventors have found that a substantial increase in sensitivity can be obtained by use of the invention in conjunction with a quadrupole mass analyzer fitted with an "off-axis" detector, in which there is no line-of-sight path between the sampling aperture and the detector. It therefore appears that an important cause of the background noise observed in prior discharge spectrometers of this kind is due to high energy photons or other energetic species generated in the plasma which pass through the sampling aperture and strike the surfaces of the mass analyzer or other components.

The inventors have also found that in the case of a pulsed glow discharge ionization source the fluctuation in the background which still remains can be reduced by positioning the electrodes in the way described. Use of two cylindrical electrodes spaced apart in the direction of flow of the gas appears to produce a more stable discharge than the prior arrangement, described by Gould and Miller, in which the electrodes were disposed opposite to one another.

Figure 2A:
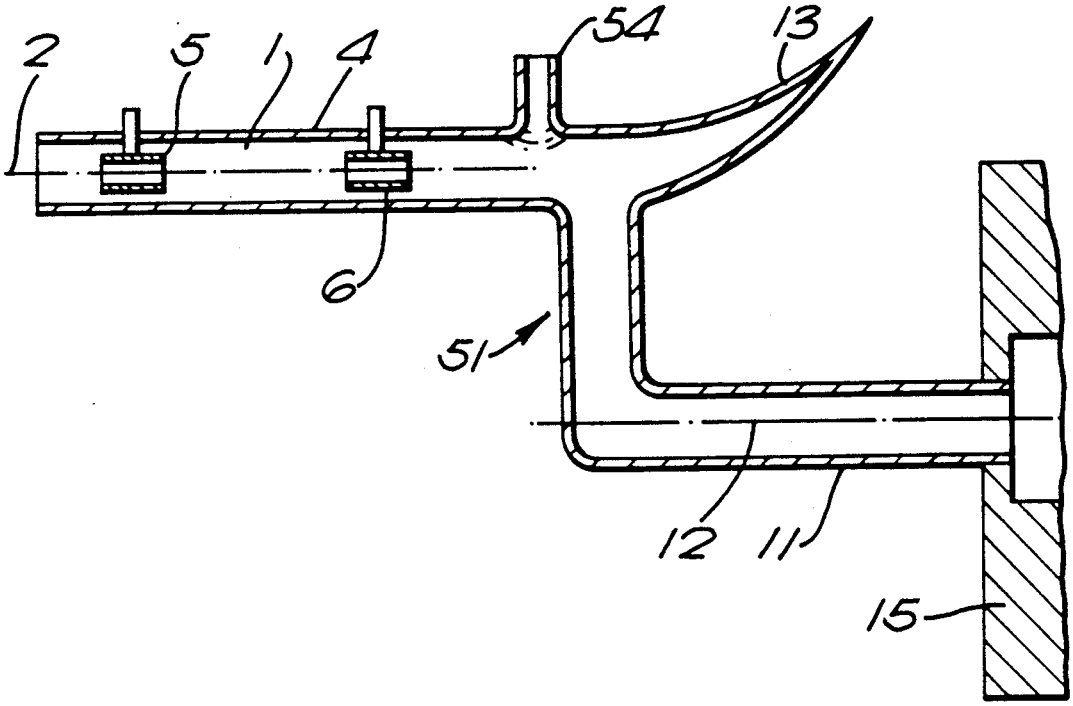
Figure 2B:
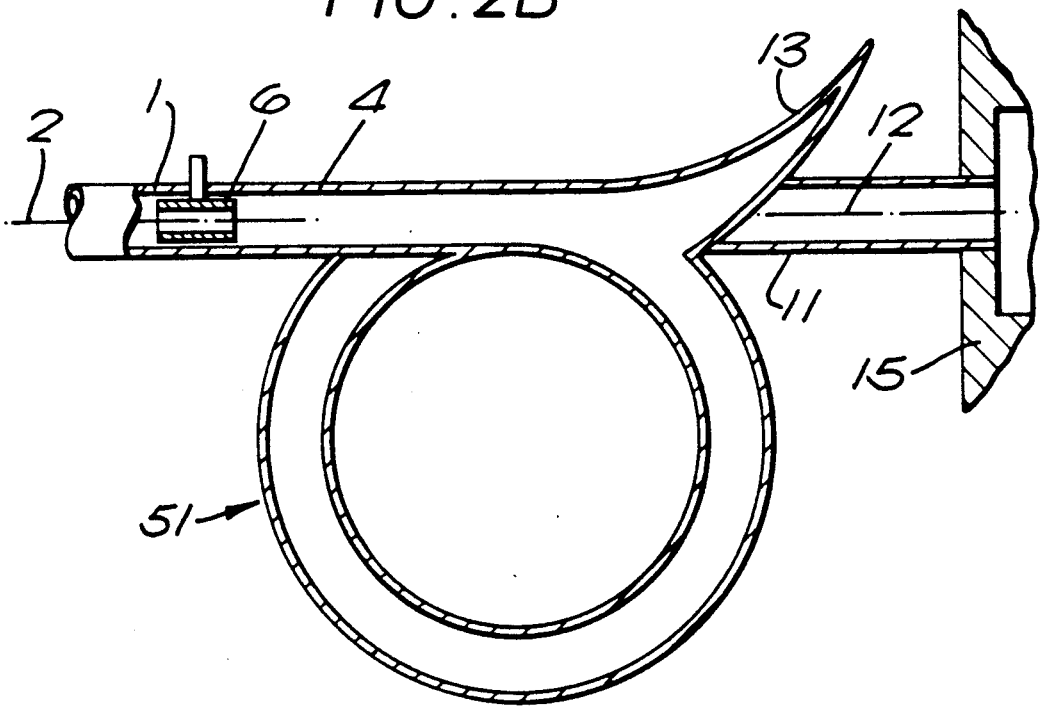
Figure 3:
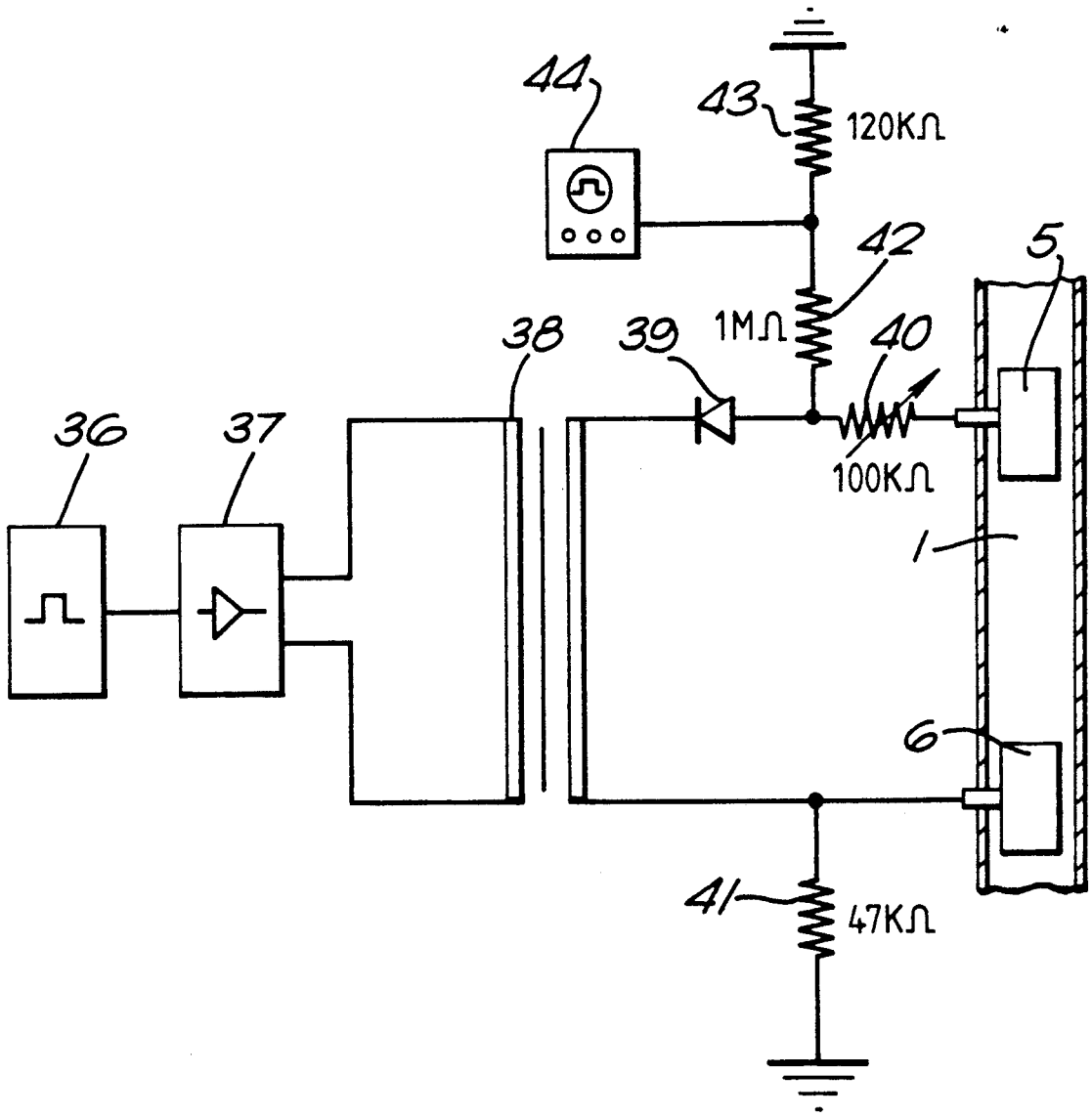

Preferred embodiments of the invention will now be described in greater detail and by reference to the figures, in which:

FIG. 1 is a sectional drawing of a mass spectrometer according to the invention;

FIGS. 2*a* and 2*b* show alternative embodiments of part of the apparatus of FIG. 1; and FIG. 3 is a drawing of an electrical circuit suitable for use with the spectrometer of FIG. 1.

Referring first to FIG. 1, a gas (typically air, oxygen or nitrogen) containing the sample to be analyzed enters a plasma enclosure 1 in the direction of arrow 2 and flows generally along a first axis 3 in a conduit means 51 comprising an entrance portion or first conduit 4, and an exit portion or second conduit 11. Conduit means 51 conveniently comprises a borosilicate glass tube approximately 1 cm diameter. Two hollow cylindrical electrodes 5 and 6 approximately 1 cm long and 8 mm diameter are supported by connection posta 7 and 8 which pass through holes in the wall of plasma enclosure 1 into which they are sealed by an epoxy resin adhesive. Electrodes 5 and 6 comprise nickel, tantalum or molybdenum foil, approximately 0.25 mm thick, formed into a cylinder and attached to connection posts 7 and 8. They are spaced apart by approximately 3 cm. A pulsed direct voltage is applied to the electrodes by means of a pulsed power supply 9, described in detail below.

The exit portion or second conduit 11, generally aligned with a second axis 12, intersects the entrance portion 4 at a point approximately 3 cm downstream or electrode 6, and a light path interrupting means 13, typically a Woods' horn, is formed at the end of the entrance portion 4 in order to trap photons which are travelling in the direction of the first axis 3 and prevent them being reflected into the exit portion. The end of the exit portion remote from entrance portion 4 communicates with a sampling chamber 14 formed in a cylindrical source body 15 which is made from stainless steel or aluminium. The exit portion may be attached to the source body 15 by means of a glass-to-metal seal or by epoxy resin adhesive.

The sampling chamber 14 is provided with a means 16 for venting gas which does not pass through the sampling aperture 22 (see below) and a pressure-measuring port 17 as shown in FIG. 1.

Port 17 is connected to a pressure gauge 18. In the preferred embodiment shown in FIG. 1, a glow discharge 10 is produced in the plasma enclosure 1 and the pressure of gas in the enclosure is between 0.1 and 20 torr. This is achieved by means of a mechanical vacuum pump 19. Pressure gauge 18 may then comprise a thermocouple or thermal conductivity vacuum gauge. Gas is admitted into the plasma enclosure 1 through an adjustable needle valve (not shown), typically at a flow rate of between 0.5 and 4 at .1. $min^{-1}$, and the valve is adjusted to obtain the desired pressure in the sampling chamber 14.

A sampling member 20 which comprises a conical portion and an annular flange portion is fitted as shown on the source body 15 so that the conical portion protrudes into the sampling chamber 14 and the flange portion seals to the source body 15 by means of an O-ring seal 21. A sampling aperture 22 is formed in the apex of the sampling member 20 through which ions and a small proportion of the gas in the sampling chamber 14 may pass. The sampling aperture 22, typically about 100 micron diameter, is located on the second axis 12.

The flange portion of the sampling member 20 spaces the source body 15 from a flange 23 on an intermediate vacuum housing 24 which comprises the flanges 23 and 26 and a cylindrical tube 25. The tube 25 is fitted with a large diameter pumping port 27, and flange 23 is sealed to the rear surface of the flange portion of sampling member 20 by another O-ring seal 45. A high vacuum pump 28 is connected to the port 27 and maintains the pressure in the intermediate housing 24 within the range $10^{-5}$ torr to $10^{-2}$ torr. The pump 28 may be a turbomolecular pump or a diffusion pump.

Several electrostatic lens elements 29 and 30, each having a circular aperture, are supported on four ceramic rods mounted between flange 26 and the source body 15. The elements are spaced apart on the ceramic rods by tubular ceramic insulators 31. The first element 29 comprises a flanged cone with a hole in its apex. It is maintained at a potential of polarity opposite to that of the ions to be mass analyzed so that an extraction field which penetrates through aperture 22 in the sampling member 20 is generated. This increases the efficiency of the extraction through the aperture 22 of the ions which enter the sampling chamber 14. The remaining lens elements 30 are arranged as a pair of conventional electrostatic lenses which transmit the ions through an entrance aperture 32 of a mass analyzer 33. Entrance aperture 32 is formed in an electrode 47 which is seated on a flat PTFE gasket 50 located in a recess on the rear of flange 26. The edge of electrode 47 is chamfered to receive an O-ring 48 which locates the electrode in the centre of the recess so that it is insulated from flange 26. A flat securing ring 49 is bolted to flange 26 to hold O-ring 48 and the electrode 47 in such a way that there is a gap between the electrode and the flange. This arrangement allows electrode 47 to be maintained at a potential different from that on flange 26 while maintaining differential pumping across the entrance aperture 32. The potential of electrode 47 is maintained at a value which ensures that the energy of the ions entering the mass analyzer 33 is within a desired range.

The potentials applied to the lens elements 30 and the conical element 29 are adjusted to optimize the transmission of ions from the sampling chamber 14 through the entrance aperture 32.

The mass analyzer 33 comprises a conventional quadrupole analyzer having an ion detector comprising an off-axis electron multiplier operated in the pulse counting mode. The analyzer 33 is disposed in an evacuated housing 34 which is maintained at a pressure of less than $10^{-3}$ torr, or more preferably $10^{-5}$ torr, by means of a second high vacuum pump (not shown), typically a turbomolecular pump. A flange on housing 34 is sealed to flange 26 on the intermediate housing 24 by means of a copper gasket joint 35.

In accordance with one aspect of the invention the angle between the first axis 3 and the second axis 12, and the position of their intersection downstream of electrode 6, is made such that there is no line-of-sight path between the plasma enclosure 1 and any part of the quadrupole mass analyzer 33 and between the plasma enclosure 1 and the sampling member 20 and lens elements 29 and 30. In the FIG. 1 embodiment the angle is 90°, and the light path interrupting means 13 prevents reflection of any photons produced in the plasma enclosure 1 being reflected through the aperture 22 in the sampling member 20 along axis 12. Additionally, in the illustrated embodiment, there is no line-of-sight path between the plasma enclosure 1 and the sampling member 20.

FIG. 2*a* shows an alternative arrangement for ensuring that no line-of-sight path exists between the interior of the plasma enclosure 1 and the sampling aperture in which the first axis 2 and the second axis 12 are displaced from one another. The light path interrupting means 13 may then be aligned with axis 2, as shown. FIG. 2*b* shows another alternative arrangement in which the light path interrupting means 13 comprises a single turn coil formed in the conduit means 51. A Wood's horn 52 may also be incorporated to receive light from the plasma which travels along the first axis 3. Use of the FIG. 2*b* embodiment allows a very compact instrument to be constructed.

The cross-sectional area of the conduit means 51 is made sufficiently large to ensure substantially laminar flow through the plasma enclosure 1 to the sampling chamber 14. In the case of a cylindrical conduit and a flow rate of 0.5 to 4 at .1. $min^{-1}$ in the pressure range 0.1 to 20 torr, this can be achieved if the internal diameter of the conduit is about 8 mm and the total length from the needle valve to the sampling aperture 22 is approximately 15 cm. The provision of relatively large radii at the junction of the two conduit portions (eg, as at 46) also helps to maintain laminar flow.

As explained in general terms, samples may also be introduced into the conduit means 51 between the plasma enclosure 1 and the mass analyzer, for example at the sample introduction port 54 (FIG. 2*a*). Port 54 may comprise another conduit for supplying a gaseous sample (or a ga containing the sample). Alternatively, port 54 may comprise an injection port allowing a sample to be injected from a syringe. It will be appreciated that ports similar to port 54 could be incorporated in the FIG. 1 and FIG. 2*b* embodiments.

As previously explained, the electrodes 5 and 6 are spaced apart by approximately 3 cm. It is believed that the high efficiency of the formation of negative ions in a source of this kind is due to the efficient attachment of electrons which have been formed in the discharge to sample molecules during the period after the discharge has been turned off. Consequently, because of the flow of gas through the plasma enclosure 1, the maximum concentration of negative ions is formed downstream of electrode 6, so that the distance between electrode 6 and the sampling member 20 should be 2 cm or greater. This theory also explains why good results can also be obtained when a sample is introduced downstream of the plasma enclosure 1, for example at port 54 (FIG. 2*a*).

Referring next to FIG. 3, a preferred embodiment of the pulsed power supply generally indicated by 9 comprises a pulse generator 36 (which generates pulses of about 5 V amplitude) and a conventional 120 W audio amplifier 37, typically of the integrated circuit type, which is driven by the output of the pulse generator. The low impedance output of amplifier 37 is fed to the primary of a pulse transformer 38 which generates a peak voltage of between 1 and 2 kV across its secondary winding. For optimum performance, the rise time of the pulse applied to the ion source electrodes should be as fast as possible so that the transformer 38 should be a high quality component. A high-voltage diode 39 is used to provide a negative direct voltage to electrode 5 via an adjustable resistor 40 of about 100KΩ, and electrode 6 is connected to the other end of the secondary winding of the pulse transformer. Electrode 6 is grounded through a 47KΩ resistor 41. This arrangement of electrode polarities minimizes the risk of a discharge occurring between electrode 6 and the sampling member 20 (FIG. 1), but is not essential. Acceptable performance can often be obtained when the electrode polarities are reversed.

A potential divider comprising a 1MΩ resistor 42 and a 120KΩ resistor 43 is connected to the cathode of the diode 39 to enable an oscilloscope 44 to be connected as shown to monitor the shape of the pulse appearing on electrode 5. The pulse width and repetition rate are adjusted on generator 36 to obtain the maximum signal-to-noise ratio for the species being mass analyzed, as previously described. Variable resistor 40 may also be adjusted to optimize performance. It is provided to control the current in the discharge, the optimum value of which is dependent on the nature of the flowing gas and the species to be mass analyzed.

The remainder of the apparatus, including the mass analyzer 33 and the associated detection system, is conventional and need not be described in detail.

We claim:

1. A mass spectrometer for the analysis of a sample of matter comprised in a flow of gas, said spectrometer comprising:

a mass analyzer;

means defining a plasma enclosure;

means for causing gas comprising a said sample of matter to flow through said plasma enclosure;

means for forming a plasma in gas within said plasma enclosure;

a sampling member, said sampling member having a sampling aperture through which ions characteristic of said sample of matter may pass into said mass analyzer;

conduit means through which gas and products formed in said plasma may flow from said plasma enclosure to said sampling member, said conduit means being constructed such that there exists no line-of-sight path between the interior of said plasma enclosure and said sampling aperture;

means for venting from said conduit means gas which does not pass through said sampling aperture; and means for maintaining said mass analyzer at a pressure of less than $10^{-3}$ torr.

2. A mass spectrometer as claimed in claim 1 wherein said conduit means comprises a first conduit member through which gas from said plasma enclosure may flow and a second conduit member through which gas from said first conduit member may flow to said sampling aperture, the axes of said first and second conduit members intersecting at an angle and position such that there is no line-of-sight communication between the interior of said plasma enclosure and any part of said mass analyzer.

3. A mass spectrometer according to claim 1 wherein said means for forming a plasma comprises electrodes disposed in said plasma enclosure and connected to a direct current power supply and arranged to produce a DC glow discharge as said plasma, and wherein said means for venting comprises pumping means for maintaining the pressure of gas in said plasma enclosure within the range 0.1 to 20 torr.

4. A mass spectrometer according to claim 3 wherein said direct current power supply is arranged to provide a pulsed output whereby said glow discharge may be repetitively established in said plasma enclosure for short periods separated by periods when no such discharge is present.

5. A mass spectrometer according to claim 4 wherein said electrodes are spaced apart in the direction of the flow of gas through said plasma enclosure.

6. A mass spectrometer according to claim 5 wherein each said electrode comprises a hollow cylinder disposed with its axis aligned with said direction of the flow.

7. A mass spectrometer for the analysis of a sample of matter, said spectrometer comprising:

a mass analyzer;

means defining a plasma enclosure;

means for causing gas to flow through said plasma enclosure;

means for forming a plasma in said gas within said plasma enclosure;

a sampling member, said sampling member having a sampling aperture through which ions characteristic of said sample may pass into said mass analyzer;

conduit means through which gas may flow from said plasma enclosure to said sampling member;

means for introducing a said sample of matter into said gas in said conduit means whereby to form ions characteristic of said sample by reaction of said sample with excited species present in said gas which have been generated in a plasma in said plasma enclosure;

means for venting from said conduit means gas which does not pass through said sampling aperture; and means for maintaining said mass analyzer at a pressure of less than $10^{-3}$ torr;

said conduit means being so constructed that there is no line-of-sight path between the interior of said plasma enclosure and said sampling aperture.

8. A mass spectrometer according to either one of claims 1 and 7 wherein said conduit means comprises an entrance portion through which gas leaving said plasma enclosure may flow generally along a first axis and an exit portion through which gas may flow generally along a second axis towards said sampling member, and wherein said first and second axes are inclined to one another.

9. A mass spectrometer according to either one of claims 1 and 7 wherein said conduit means comprises an entrance portion through which gas leaving said plasma enclosure may flow generally along a first axis and an exit portion through which gas may flow generally along a second axis towards said sampling member, and wherein said first and second axes are displaced from one another.

10. A mass spectrometer according to either one of claims 1 and 7 wherein said conduit means comprises an entrance portion through which gas leaving said plasma enclosure may flow and an exit portion through which gas may flow towards said sampling member, and wherein light path interrupting means are provided between said entrance and exit portions.

11. A mass spectrometer according to either one of claims 1 and 7 wherein the cross-sectional area of said conduit means is so selected and the means for causing gas flow is so arranged as to be capable of providing substantially laminar gas flow in said conduit means.

12. A mass spectrometer according to claim 2 wherein said means for forming a plasma comprises electrodes disposed in said plasma enclosure and connected to a direct current power supply and arranged to produce a DC glow discharge as said plasma, and wherein said means for venting comprises pumping means for maintaining the pressure of gas in said plasma enclosure within the range 0.1 to 20 torr.

13. A mass spectrometer according to claim 12 wherein said direct current power supply is arranged to provide a pulsed output whereby said glow discharge may be repetitively established in said plasma enclosure for short periods separated by periods when no such discharge is present.

14. A mass spectrometer according to claim 13 wherein said electrodes are spaced apart in the direction of the flow of gas through said plasma enclosure.

15. A mass spectrometer according to claim 14 wherein each said electrode comprises a hollow cylinder disposed with its axis aligned with said direction of the flow.

16. A method of analyzing a sample of matter contained in a flow of gas, said method comprising:

a) causing gas containing said sample to flow through a plasma enclosure and a plasma to be formed therein;

b) conducting gas leaving said plasma enclosure through a conduit means to a sampling member having a sampling aperture therein thereby permitting ions characteristic of said sample present in the gas to pass from said conduit member through said aperture and into a mass analyzer maintained at a pressure of less than $10^{-3}$ torr and venting from said conduit means gas which does not pass through said sampling aperture; and c) mass analyzing ions characteristic of said sample of matter entering said mass analyzer;

said conduit means being so constructed that there exists no line-of-sight path between said plasma and said sampling aperture.

17. A method as claimed in claim 16 wherein said conduit means comprises a first conduit member through which gas from said plasma enclosure may flow and a second conduit member through which gas from said first conduit member may flow to said sampling aperture, said first and second conduit members each having an axis, the axes of said first and second conduit members intersecting at an angle and position such that there is no line-of-sight communication between the interior of said plasma enclosure and said sampling aperture.

18. A method according to claim 17 wherein said plasma comprises a DC glow discharge and the pressure in said plasma enclosure is maintained in the range 0.1–20 torr.

19. A method according to claim 18 wherein said glow discharge is repetitively created in said plasma enclosure for periods of approximately 5 us at a repetition rate between 100 Hz and 10 KHz.

20. A method according to claim 19 in which said repetition rate is between 200 and 500 Hz.

21. A method according to either of claims 19 and 20 in which the flow rate of gas into said plasma enclosure is between 500 at $cm^3\ min^{-1}$ and 4000 at $cm^3\ min^{-1}$.

22. A method of analyzing a sample of matter, said method comprising:

a) flowing a gas through a plasma enclosure and forming a plasma therein;

b) conducting gas leaving said plasma enclosure through a conduit means to a sampling member having a sampling aperture therein;

c) introducing a said sample of matter into said gas in said conduit means whereby to produce ions characteristic of said sample by reaction of said sample with excited species generated by said plasma;

d) permitting ions characteristic of said sample present in said gas in said conduit means to pass through said sampling aperture and into a mass analyzer maintained at a pressure of less than $10^{-3}$ torr and venting from said conduit means gas which does not pass through said sampling aperture; and e) mass analyzing ions characteristic of said sample of matter entering said mass analyzer;

said conduit means being so constructed that there exists no line-of-sight path between said plasma and said sampling aperture.

23. A method according to either one of claims 16 and 22 wherein gas is constrained to flow generally along a first axis as it flows through an entrance portion of said conduit means and generally along a second axis as it flows through an exit portion of said conduit means, said first and second axes being inclined to one another.

24. A method according to either one of claims 16 and 22 wherein gas is constrained to flow generally along a first axis as it flows through an entrance portion of said conduit means and generally along a second axis as it flows through an exit portion of said conduit means, said first and second axes being displaced from one another.

25. A method according to either one of claims 16 and 22 wherein said conduit means is provided with light path interrupting means arranged to prevent light from said plasma entering said sampling aperture.

26. A method according to claim 22 wherein said plasma comprises a DC glow discharge and the pressure in said plasma enclosure is maintained in the range 0.1–20 torr.

27. A method according to claim 26 wherein said glow discharge is repetitively created in said plasma enclosure for periods of approximately 5 us at a repetition rate between 100 Hz and 10 KHz.

28. A method according to claim 27 in which said repetition rate is between 200 and 500 Hz.

29. A method according to either of claims 27 and 28 in which the flow rate of gas into said plasma enclosure is between 500 at $cm^3$ $min^{-1}$ and 4000 at $cm^3$ $min^{-1}$.

* * * * *